US006676449B2

(12) United States Patent
Ji et al.

(10) Patent No.: US 6,676,449 B2
(45) Date of Patent: Jan. 13, 2004

(54) ELECTRICAL CONNECTOR WITH GROUNDING SHELL

(75) Inventors: Zhang Jiang Ji, Kunsan (CN); Qiang Chen, Kunsan (CN); GuangXing Shi, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/201,824

(22) Filed: Jul. 23, 2002

(65) Prior Publication Data

US 2003/0119360 A1 Jun. 26, 2003

(30) Foreign Application Priority Data

Dec. 26, 2001 (TW) ..... 90222976 U

(51) Int. Cl.[7] ..... H01R 13/648
(52) U.S. Cl. ..... 439/607; 439/79
(58) Field of Search ..... 439/607, 567, 439/608, 609, 108, 101, 79–83, 571

(56) References Cited

U.S. PATENT DOCUMENTS 5,755,595 A 5/1998 Davis
5,947,769 A * 9/1999 Leonard et al. ..... 439/607
6,086,421 A 7/2000 Wu et al.
6,203,374 B1 * 3/2001 Huang et al. ..... 439/607
6,287,146 B1 * 9/2001 Avery et al. ..... 439/607
6,379,181 B1 * 4/2002 Chang et al. ..... 439/567
6,454,603 B2 * 9/2002 Casey et al. ..... 439/607
6,468,108 B1 * 10/2002 Wu ..... 439/567

* cited by examiner

*Primary Examiner*—Hien Vu
(74) *Attorney, Agent, or Firm*—Wei Te Chung

(57) ABSTRACT

An electrical connector (1) includes an insulating housing (2), a plurality of contacts (4) received in a plurality of passageways (24) defined in the housing, a metal shell (3) and a spacer (5). The housing has a pair of protrusions (26) projecting downwardly on a lower wall (22) thereof. The shell encloses the insulating housing and comprises an upper and a lower body portions (30, 31). The lower body portion defines a pair of receiving apertures (310), which each receive a corresponding protrusion of the housing therein. The spacer has a base plate (50) defining a plurality of through holes (500) to allow extension of the contacts therethrough. The spacer is assembled to the housing and presses the lower body portion of the shell against the lower wall of the housing.

10 Claims, 5 Drawing Sheets

ELECTRICAL CONNECTOR WITH GROUNDING SHELL

BACKGROUND OF THE INVENTION

1. Field of the Invention

The present invention relates to an electrical connector for mounting on a printed circuit board, and particularly to an electrical connector with a grounding shell.

2. Description of Related Art

Electrical connectors are widely used in computers to transmit electrical signals. When the connectors are used in high-speed data transmission applications, the problem of electromagnetic interference (EMI) increases. A metal shell is used to enclose an insulating housing of the electrical connector for preventing outside EMI from affecting the signals transmitting through the connector, and to prevent EMI generated from within the connector from influencing outside circuits. The metal shell is generally stamped from a metal blank and is in a rectangular, box-like form. Side edges of the metal shell are engaged with each other by dovetail-shaped protrusions formed on the metal shell engaging in dovetail-shaped recesses defined in the metal shell. In practice, an engaging force between the side edges of the metal shell is not large enough and the side edges are easily disengaged from each other. Furthermore, after the metal shell is assembled on the housing, a gap exists between the metal shell and the housing and the gap is difficult to eliminate. When plugging or unpulling the connector from a mating connector, the mating connector may be damaged by the side edges of the metal shell. It is also relatively complex to assemble the metal shell, which increases the cost of the connector.

Hence, it is desirable to provide an electrical connector with an improved metal shell to overcome the above-mentioned disadvantages.

SUMMARY OF THE INVENTION

Accordingly, one object of the present invention is to provide an electrical connector with a metal shell enclosing an insulating housing thereof to provide shielding against electromagnetic interference.

Another object of the present invention is to provide an electrical connector with a spacer pressing against a metal shell, to prevent the shell from separating from the insulating housing.

In order to achieve the above-mentioned objects, an electrical connector comprises an insulating housing, a plurality of contacts, a metal shell and a spacer. The housing has opposite upper and lower walls and defines a mating cavity therebetween. A plurality of passageways are defined in the upper and lower walls and in communication with the mating cavity, a pair of protrusions extend downwardly from the lower wall. Each contact comprises a mating portion received in the passageway. The shell is stamped from a metal sheet and encloses the insulating housing. The shell comprises upper and lower body portions. The lower body portion includes a pair of end junction portions. Each end junction portion defines a receiving aperture for receiving a corresponding protrusion therein. The spacer has a base plate defining a plurality of through holes to allow extension of the contacts therethrough. The spacer is assembled to the housing and presses the lower body portion of the shell against the lower wall of the housing, holding the shell in firm retention against the housing.

Other objects, advantages and novel features of the invention will become more apparent from the following detailed description when taken in conjunction with the accompanying drawings.

DETAILED DESCRIPTION OF THE INVENTION

Figure 1:
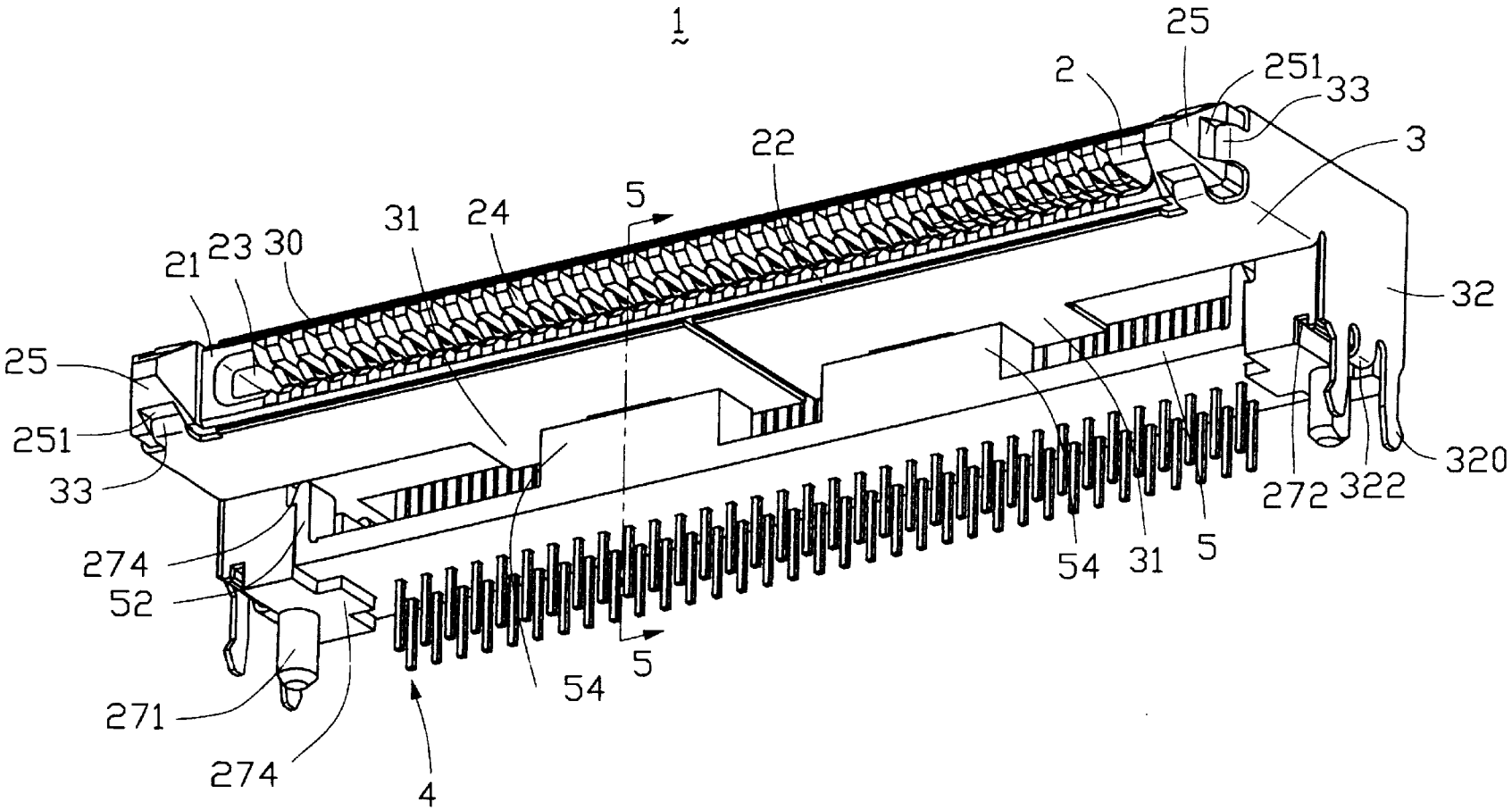
FIG. 1 is a perspective view of an electrical connector in accordance with the present invention.

Reference will now be made to the drawing figures to describe the present invention in detail.

As shown in FIG. 1, an electrical connector 1 in accordance with the present invention includes an insulating housing 2, a metal shell 3 enclosing the housing 2, a plurality of contacts 4 received in the housing 2, and a spacer 5 for organizing the contacts 4 and securing the metal shell 3 to the housing 2.

Figure 2:
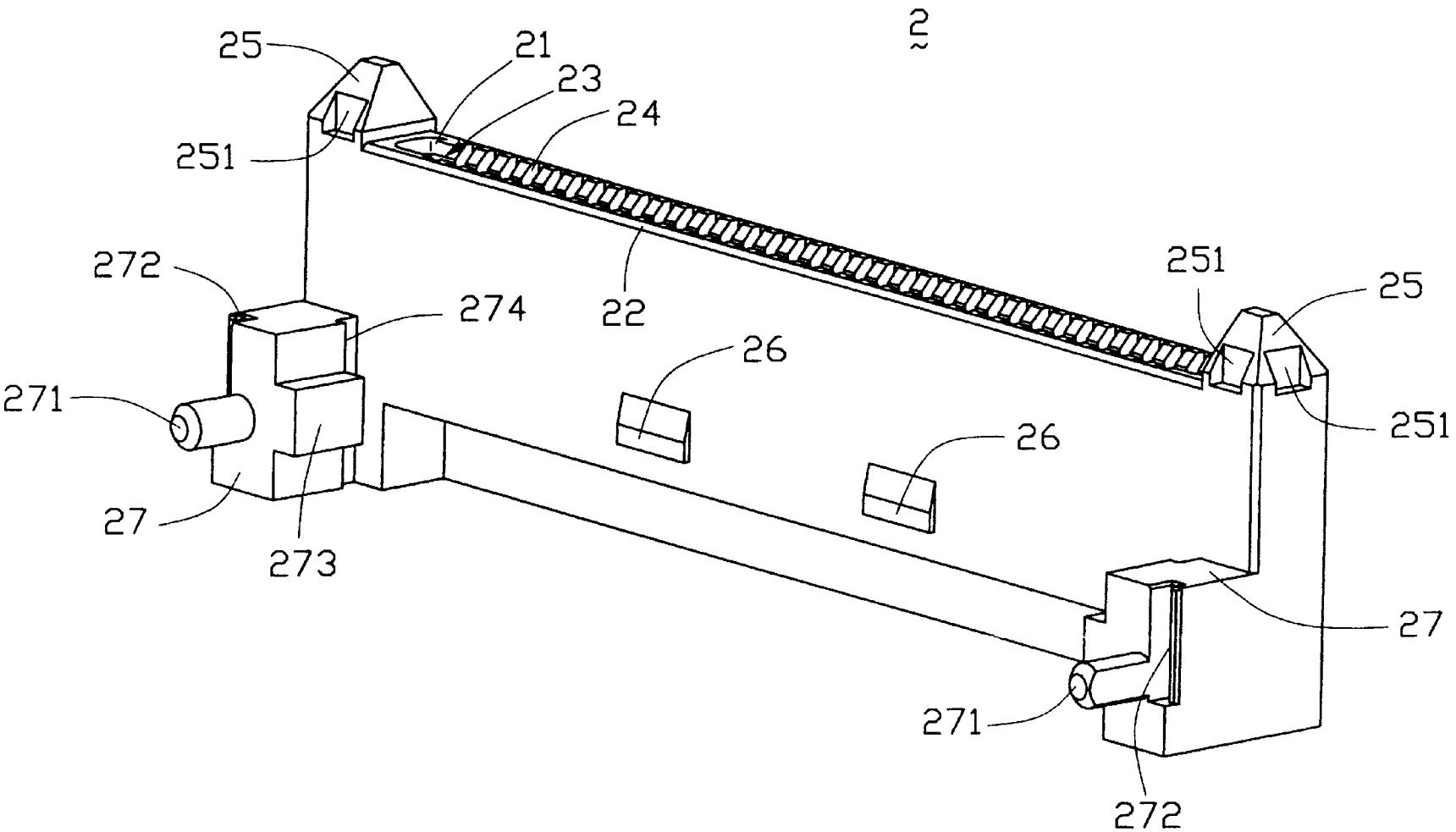
FIG. 2 is a perspective view of a housing of the electrical connector of FIG. 1.

Further referring to FIG. 2, the housing 2 is integrally molded and comprises opposite upper and lower walls 21 and 22. The upper and lower walls 21, 22 connect with each other at opposite lateral sides thereof and define a mating cavity 23 therebetween. A plurality of passageways 24 is defined in the upper and lower walls 21, 22 and in communication with the mating cavity 23. A pair of towers 25 projects forwardly from opposite lateral sides of the upper and lower walls 21, 22 for guiding a mating connector to properly mate with the electrical connector 1. Each tower 25 defines a plurality of recesses 251. A pair of wedge-shaped protrusions 26 extends downwardly from the lower wall 22. A pair of opposite support portions 27 extend downwardly from the lower wall 22 and adjacent to a pair of ends of the housing 2. A post 271 extends downwardly from a bottom face of the support portion 27 for facilitating the housing 2 to mount on a printed circuit board. A slot 272 is defined in an outer face of each support portion 27. A pair of blocks 273 is formed on opposite inner side faces of the support portions 27. Each support portion 27 defines a slit 274 in an inner side face thereof and adjacent to the lower wall 22.

Figure 3:
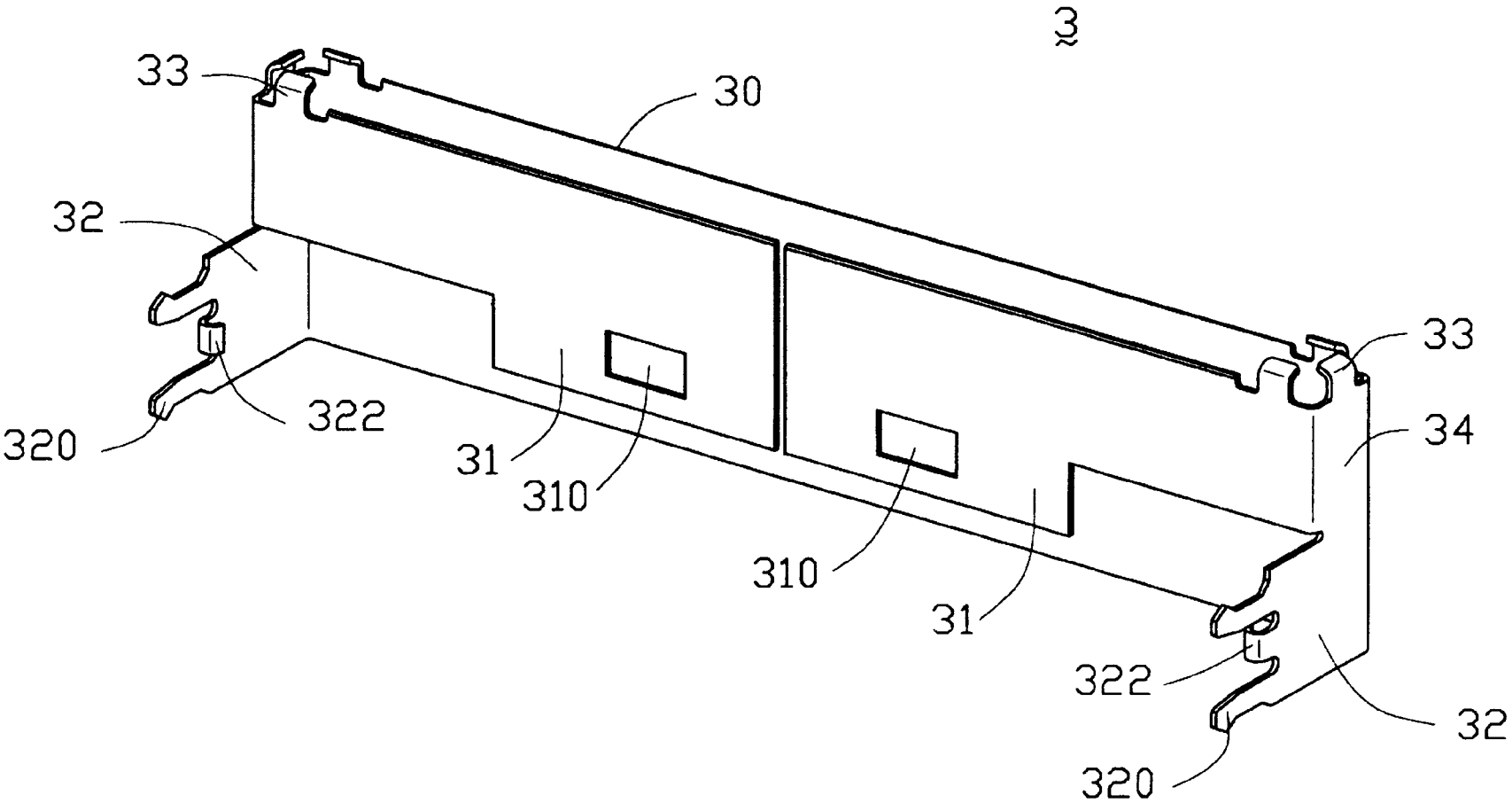
FIG. 3 is a perspective view of a shell of the electrical connector of FIG. 1.

Referring to FIG. 3, the shell 3 is stamped from a single metal sheet and has an upper body portion 30, a pair of side portions 34 extending downwardly from opposite ends of the upper body portion 30, and a lower body portion 31 composed of a pair of end junction portions (not labeled) of the metal sheet. A pair of extending tab members 32 extends downwardly from the pair of side portions 34. The lower body portion 31 defines a pair of receiving apertures 310, are in each end junction portion of the metal sheet. Each receiving aperture 310 corresponds to a protrusion 26 of the housing 2. Each extending tab member 32 has a pair of opposite barbs 320 extending downwardly and a retention tab 322 extending backwardly therefrom. A plurality of spring tabs 33 extends from the upper body portion 30, the side portions 34 and the lower body portion 31.

The pin-type contacts 4 are received in the passageways 24 of the housing 2. Each contact 4 includes a mating portion 40 and a tail portion 42.

Figure 4:
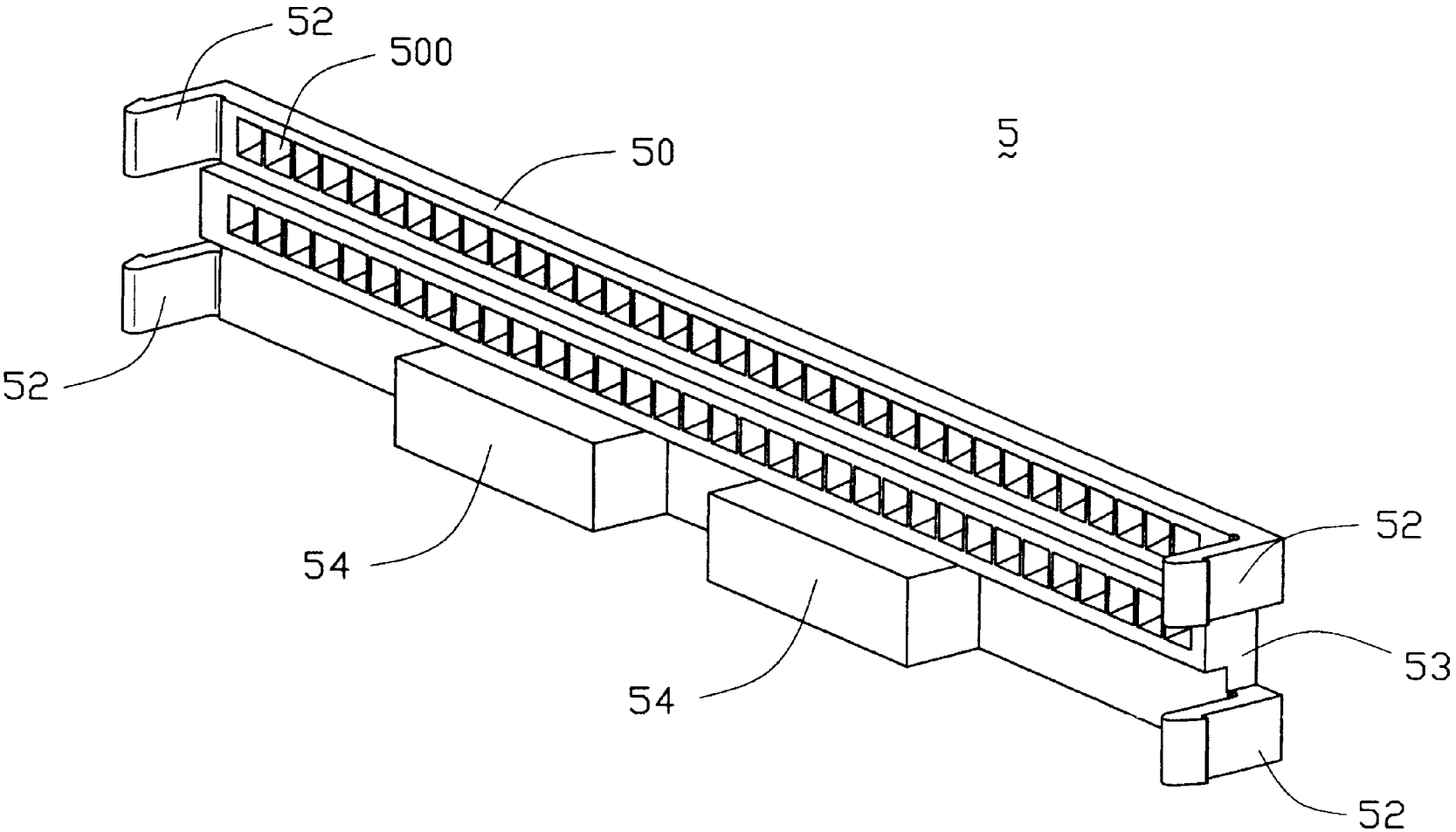
FIG. 4 is a perspective view of a spacer of the electrical connector of FIG. 1.

As shown in FIG. 4, the spacer 5 comprises a base plate 50 having a plurality of through holes 500 defined therein, a pair of blocks 54 formed on a top surface of the base plate 50, and two pairs of retention hooks 52 formed on opposite ends of the spacer 5. A channel 53 is defined between each pair of retention hooks 52 locating at the ends of the spacer 5.

Figure 5:
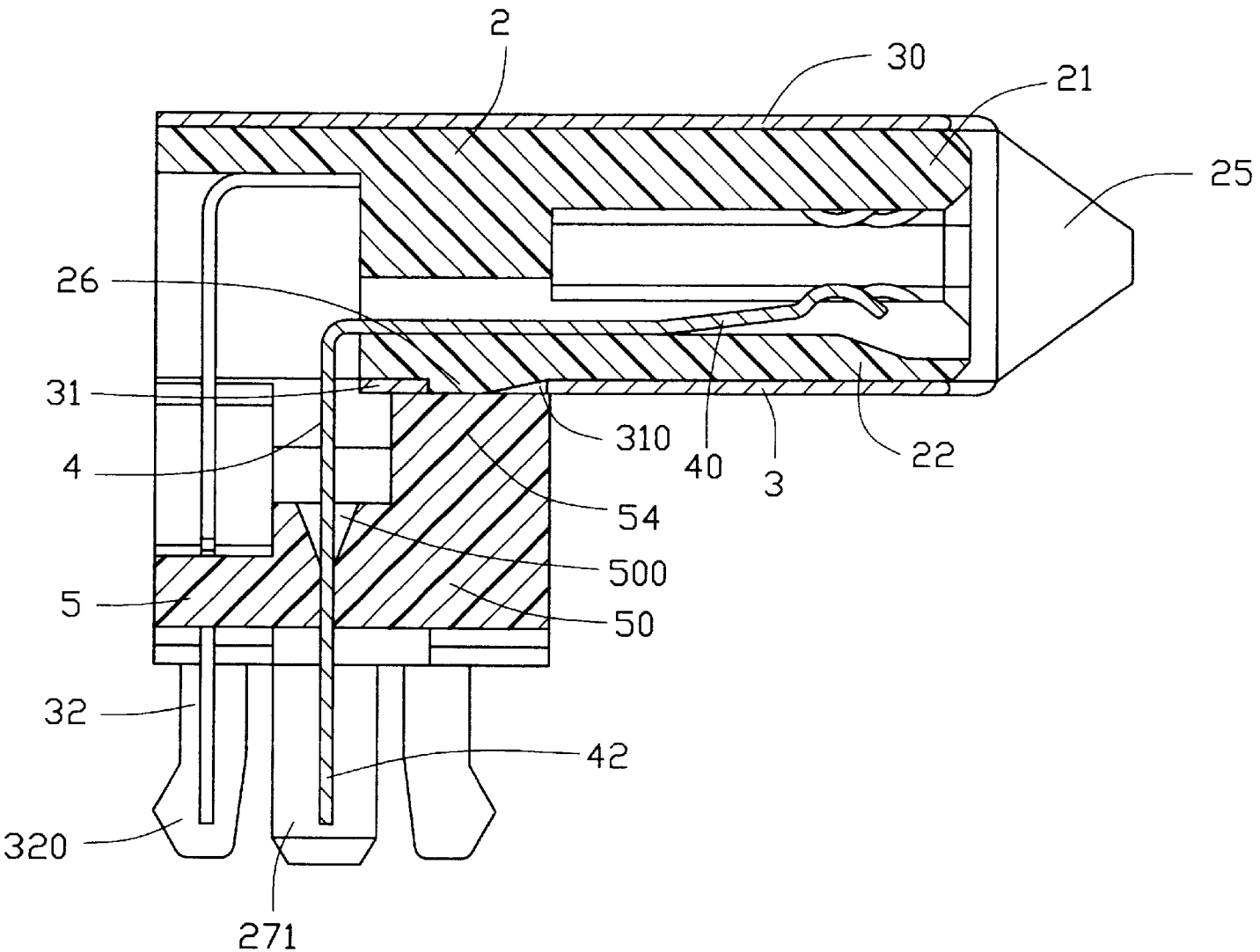
FIG. 5 is a cross-sectional view of the electrical connector taken along a line 5—5 in FIG. 1.

Referring to FIGS. 1 and 5, in assembly, the contacts 4 are received in the housing 2 with the mating portions 40 received in the passageways 24 and the tail portions 42 extending downwardly beyond the lower wall 22 of the housing 2. The shell 3 encloses the housing 2 with the receiving apertures 310 of the shell 3 receiving the protrusions 26 of the housing 2 therein to prevent both end junction portions of the shell 3 from moving away from each other. The spring tabs 33 of the shell 3 are secured in the recesses 251 of the towers 25. The extending tab members 32 of the shell 3 abut against outer faces (not labeled) of the support portions 27, with the barbs 320 extending downwardly for engaging with the printed circuit board, and with the retention tabs 322 being secured in the slots 272 of the support portions 27. The spacer 5 is assembled to the housing 2 with the tail portions 42 of the contacts 4 extending through the through holes 500. Both pairs of retention hooks 52 of the spacer 5 are retained in the slits 274 of the support portions 27, with the pair of blocks 273 of the support portions 27 fitting into the channels 53 of the spacer 5. The blocks 54 of the spacer 5 press against the lower body portion 31 of the shell 3 and the protrusions 26 of the housing 2, securing the lower body portion 31 of the shell 3 to the lower wall 22 of the housing 2. Thus, the shell 3 is tightly and securely assembled to the housing 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for being mounted on a printed circuit board, comprising:

an insulating housing having opposite upper and lower walls which define a mating cavity therebetween, a plurality of passageways being defined in the upper and lower walls, which passageways are in communication with the mating cavity, and a pair of protrusions formed on the lower wall;

a plurality of contacts each comprising a mating portion received in a corresponding passageway;

a shell stamped from a metal sheet and enclosing the insulating housing and comprising upper and lower body portions, the lower body portion being including a pair of end junction portions, each end junction portion defining a receiving aperture therethrough for receiving a corresponding protrusion of the housing therein; and a spacer having a base plate defining a plurality of holes for extension of tail portions of the contacts therethrough, the spacer being assembled to the housing and pressing the lower body portion of the shell against the lower wall of the housing to prevent both end junction portions from moving far away from each other; wherein the housing has a pair of support portions extending downwardly from the lower wall of the housing and adjacent to a pair of ends of the housing; wherein the spacer has two pairs of retention hooks extending from opposite ends of the base plate and engagable in two pairs of slits defined in the support portions of the housing, and a channel is defined between each pair of retention hooks located at a same end of the spacer; wherein the spacer comprises a pair of blocks extending upwardly from the base plate and pressing against the protrusions of the housing and the end junction portions of the shell to secure the end junction portions to the lower wall of the housing; wherein the shell comprises a pair of side portions connecting the upper body portion and lower body portion of the shell; wherein each support portion of the housing has a block formed on an inner side face thereof, and the block is received in the channel between the retention hooks.

2. The electrical connector as claimed in claim 1, wherein the protrusions extend downwardly from the lower wall of the housing.

3. The electrical connector as claimed in claim 1, wherein the spacer has a pair of retention hooks extending from opposite ends of the base plate and engagable in a pair of slits defined in the support portions of the housing.

4. The electrical connector as claimed in claim 1, wherein each side portion has an extending tab member extending downwardly and abutting against an outside of the support portion.

5. The electrical connector as claimed in claim 4, wherein each extending tab member has a pair of opposite barbs extending downwardly therefrom for being mounted to the printed circuit board.

6. The electrical connector as claimed in claim 5, wherein each extending tab member further has a retention tab between the opposite barbs and bent inwardly, the support portion of the housing defines a slot to receive the retention tab therein.

7. The electrical connector as claimed in claim 1, wherein the protrusion is wedge-shaped.

8. The electrical connector as claimed in claim 1, wherein the housing further has a pair of towers at a pair of ends thereof and extending forwardly and beyond a mating face of the housing, each tower defining a plurality of recesses.

9. The electrical connector as claimed in claim 8, wherein a plurality of spring tabs extend from the upper body portion, the side portions and the lower body portion inwardly toward the mating face of the housing, and all the spring tabs are received into the recesses of the towers of the housing.

10. The electrical connector as claimed in claim 1, wherein the support portion has a post extending downwardly from a bottom face thereof for facilitating mounting of the housing on the printed circuit board.

* * * * *